US008904562B2

(12) United States Patent
Aquino

(10) Patent No.: US 8,904,562 B2
(45) **Date of Patent: *Dec. 9, 2014**

(54) UNOBTRUSIVE HIGH-END READY TO WEAR BODY ARMOR GARMENT

(71) Applicant: Doo Kalmanson Aquino, New York, NY (US)

(72) Inventor: Doo Kalmanson Aquino, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/028,563

(22) Filed: Sep. 17, 2013

(65) Prior Publication Data

US 2014/0013495 A1 Jan. 16, 2014

Related U.S. Application Data

(63) Continuation of application No. 12/462,306, filed on Aug. 3, 2009, now Pat. No. 8,555,412.

(51) Int. Cl.

| | |
|---|---|
| ***F41H 1/02*** | (2006.01) |
| ***F41H 5/04*** | (2006.01) |
| *F41H 1/00* | (2006.01) |

(52) U.S. Cl.

CPC ..... *F41H 1/02* (2013.01); *F41H 5/0485* (2013.01); *Y10S 428/911* (2013.01)

USPC ..... 2/2.5; 428/911; 89/36.05

(58) Field of Classification Search

CPC ..... F41H 1/02; F41H 5/04; F41H 5/0485; F41H 5/0492; F41H 5/0478; A41D 27/00; A41D 13/00; A41D 13/0015; A41D 13/0002; A41D 19/01505; A41D 31/00; A41D 13/012; A41D 27/20; A41D 31/0055; A41D 31/0061; A41D 31/0011; A41D 2300/32

USPC ..... 2/2.5

See application file for complete search history.

(56) References Cited

U.S. PATENT DOCUMENTS

| | | | | | |
|---|---|---|---|---|---|
| 2,052,684 | A | * | 9/1936 | Wlsbrod | 2/2.5 |
| 2,424,985 | A | * | 8/1947 | Howard | 2/2.5 |
| 2,517,615 | A | * | 8/1950 | Webster et al. | 2/2.5 |
| 2,743,446 | A | * | 5/1956 | Persico et al. | 2/2.5 |
| 2,747,190 | A | * | 5/1956 | Foster | 2/2.5 |
| 2,748,391 | A | * | 6/1956 | Lewis, Jr. et al. | 2/2.5 |
| 3,061,839 | A | * | 11/1962 | Foster | 2/2.5 |
| 3,337,875 | A | * | 8/1967 | Blakeney | 2/2.5 |
| 3,409,907 | A | * | 11/1968 | Barratt | 2/2.5 |
| 3,452,362 | A | * | 7/1969 | Korolick et al. | 2/2.5 |
| 3,562,810 | A | * | 2/1971 | Davis | 2/2.5 |
| 3,771,171 | A | * | 11/1973 | Mitchell | 2/2.5 |
| 3,843,969 | A | * | 10/1974 | George et al. | 2/2.5 |
| 3,891,996 | A | * | 7/1975 | Leach et al. | 2/2.5 |
| 3,973,275 | A | * | 8/1976 | Blauer | 2/2.5 |

(Continued)

*Primary Examiner* — Bobby Muromoto, Jr.

(57) ABSTRACT

This invention is a torso-body shaped frame vest-like garment that is designed to function as ballistic armor. This garment contains inserts comprised of unitary panels of pliable ballistic material capable of stopping bullets from most handguns. The use of a torso pattern sloper as a base structure for frame design allows this garment to be adapted for all types of wearable apparel besides vests such as jackets, coats, suits, shirts, etc., and allows for an increased range of movement and level of comfort. Unlike most other types of ballistic armor that is concealed by being worn under normal clothing this garment is designed to be used as outerwear that can complement casual, business, or other professional attire. Its function as fashionable, concealable, and comfortable ballistic armor is achieved by using design methods, sewing techniques, ornamental trim applications, and fabric applications common to high fashion casual and professional attire.

19 Claims, 6 Drawing Sheets

(56) References Cited

U.S. PATENT DOCUMENTS

| | | | | | |
|---|---|---|---|---|---|
| 3,988,780 | A | * | 11/1976 | Armellino | 2/2.5 |
| 4,266,297 | A | * | 5/1981 | Atkins | 2/2.5 |
| 4,413,357 | A | * | 11/1983 | Sacks | 2/2.5 |
| 4,466,135 | A | * | 8/1984 | Coppage, Jr. | 2/2.5 |
| 4,483,020 | A | * | 11/1984 | Dunn | 2/2.5 |
| 4,485,491 | A | * | 12/1984 | Rasmussen | 2/2.5 |
| 4,497,069 | A | * | 2/1985 | Braunhut | 2/2.5 |
| 4,507,802 | A | * | 4/1985 | Small | 2/2.5 |
| 4,535,478 | A | * | 8/1985 | Zufle | 2/2.5 |
| 4,608,716 | A | * | 9/1986 | Brumfield | 2/2.5 |
| 5,008,959 | A | * | 4/1991 | Coppage et al. | 2/2.5 |
| 5,072,453 | A | * | 12/1991 | Widder | 2/2.5 |
| 5,157,792 | A | * | 10/1992 | Allen et al. | 2/2.5 |
| 5,175,040 | A | * | 12/1992 | Harpell et al. | 428/113 |
| 5,325,537 | A | * | 7/1994 | Marion | 2/462 |
| 5,325,538 | A | * | 7/1994 | Schoenweiss et al. | 2/2.5 |
| 5,327,811 | A | * | 7/1994 | Price et al. | 2/2.5 |
| 5,331,683 | A | * | 7/1994 | Stone et al. | 2/2.5 |
| 5,471,906 | A | * | 12/1995 | Bachner et al. | 2/2.5 |
| 5,495,620 | A | * | 3/1996 | Schoenweiss et al. | 2/2.5 |
| 5,495,621 | A | * | 3/1996 | Kibbee | 2/2.5 |
| 5,584,737 | A | * | 12/1996 | Luhtala | 441/107 |
| 5,970,513 | A | * | 10/1999 | Kocher | 2/2.5 |
| 5,974,585 | A | * | 11/1999 | Bachner, Jr. | 2/2.5 |
| 6,088,831 | A | * | 7/2000 | Jensen et al. | 2/2.5 |
| 6,131,198 | A | * | 10/2000 | Westrick | 2/102 |
| 6,233,737 | B1 | * | 5/2001 | Ditchfield et al. | 2/2.5 |
| 6,260,196 | B1 | * | 7/2001 | van der Sleesen | 2/2.5 |
| 6,704,934 | B2 | * | 3/2004 | Graham et al. | 2/2.5 |
| 6,961,958 | B1 | * | 11/2005 | Seitzinger | 2/2.5 |
| 7,386,894 | B2 | * | 6/2008 | Straiton | 2/228 |
| 7,401,363 | B2 | * | 7/2008 | Hatfield et al. | 2/2.5 |
| 7,426,753 | B1 | * | 9/2008 | Rivers et al. | 2/2.5 |
| 8,555,412 | B2 | * | 10/2013 | Aquino et al. | 2/2.5 |
| 2002/0069444 | A1 | * | 6/2002 | Graham et al. | 2/2.5 |
| 2002/0073473 | A1 | * | 6/2002 | Bachner et al. | 2/2.5 |
| 2006/0253950 | A1 | * | 11/2006 | Kerr | 2/2.5 |
| 2007/0079414 | A1 | * | 4/2007 | Learmont | 2/2.5 |
| 2007/0079416 | A1 | * | 4/2007 | Carlson | 2/2.5 |
| 2007/0169244 | A1 | * | 7/2007 | Wells, Jr. | 2/2.5 |
| 2007/0234459 | A1 | * | 10/2007 | Stewart | 2/2.5 |
| 2008/0098500 | A1 | * | 5/2008 | Matic et al. | 2/2.5 |
| 2008/0134419 | A1 | * | 6/2008 | Kalaam et al. | 2/463 |
| 2008/0178358 | A1 | * | 7/2008 | Learmont | 2/2.5 |
| 2008/0235841 | A1 | * | 10/2008 | McDunn et al. | 2/2.5 |
| 2009/0126057 | A1 | * | 5/2009 | Rock et al. | 2/2.5 |
| 2009/0151036 | A1 | * | 6/2009 | Joseph | 2/2.5 |
| 2009/0211000 | A1 | * | 8/2009 | Roux | 2/462 |
| 2009/0255022 | A1 | * | 10/2009 | Smith et al. | 2/2.5 |

* cited by examiner

UNOBTRUSIVE HIGH-END READY TO WEAR BODY ARMOR GARMENT

The present application is a continuation of pending U.S. patent application 12/462,306 to Don Kalmanson Aquino entitled "UNOBTRUSIVE STYLISH WEARABLE APPAREL PROTECTION BODY ARMOR GARMENT VEST INCORPORATED INTO A READY TO WEAR ARTICLE OF CLOTHING AND METHOD OF FITTING AND MANUFACTURE A BALLISTIC PANEL CARRYING GARMENT" filed on Aug. 3, 2009, hereby incorporated by reference in its entirety.

FIELD OF THE INVENTION

The present invention relates generally to a constructed torso frame, e.g. with an adapted shell that conceals soft body armor which may be comfortably worn about the torso to provide constant protection delivered to the wearer that is capable of stopping bullets from most handguns in the case of a sudden attack. More particularly this invention is directed to an improved constructed shell that can be further adapted to any article of clothing such as jackets, vest, suits and the like; thus making a concealable wearable apparel protection garment to be more fashionable but will also provide fashion conscious image that is not fashionably offensive to wearer, as well as a method of making the same.

BACKGROUND OF THE INVENTION

Clothes have always been a form of art and design, combining fabrics, color, style, and functionality. Functionality of clothes is not limited to the design and the inclusion of various materials and elements, such as pockets, loops, or the like. These basic principles and their construction methods are applicable to many variations of a particular style and can be adapted to conform to the dictates of current trends. Despite the fact that fashion is constantly changing. For the most part today's clothing, typically includes pockets, belt loops, buttons, buttonholes, snaps, etc., and other design elements that can enhances its functionality.

OBJECT OF THE INVENTION

One object of the invention is to provide a concealable, comfortable, fashionable, seasonal, stylish wearable apparel protection garment that can provide reasonably adequate protection to an individual. The protective material made of a high tensile strength fiber such as a para-aramind like Kevlar™ or a ultra-high molecular weight polyethylene fiber like Spectra™ cut into a torso shape comprised of front, rear, side and center layer panels are sewn together and can be easily inserted or removed from a spacer facilitated opening of the inner layer. Therefore, an object of this invention generally speaking, and from an ergonomic perspective, is to improve and provide a wide variety of stylish, fashionable protective garments in clothes such as vest, jackets and together the garment must also appeal, as it is usually visible. The concealability of this invention resides in its mimicry of the typical type of business or formal garments worn by the general populace.

ADVANTAGES OF THE INVENTION

The advantages of the invention are many. A basic torso pattern sloper is a structure in which various configurations can be manipulated to each desired design-style, fit and form and size of different fabrics are used that can be moldable, to its intended structure shape for providing comfort and ease of movement base on the functional layer of the design structure. Methods of garment constructions, sewing machines applications and ornamental trims, fabrics other used enhancements are employed and described for providing characteristics to a wide variety of every day wear or formal attire or business attire.

A variety of improvements have been made to design satisfactory, concealed body armor type garments or so-called "bullet-proof" vests. In the past, many of these garments have been specifically designed for use by police officers and hence have concentrated on solely on attempting to provide lightweight, flexible garments which would protect against death or serious injury from ballistic threats.

Because of recent advances in the textile design and manufacture of ballistic textile materials that are resistant to penetration by a projectile, it has become possible to provide protection of seasonal, stylish, wearable apparel of ready-to-wear fashion items that is relatively lightweight yet allows or mobility of the wearer.

Until now there has not been available a lightweight, stylish, fashionable, concealable, flexible body armor that may be comfortably and unobtrusively worn under or over an ordinary clothing or as part of an ordinary jacket, vest, coats etc. . . . for long periods of time by an ordinary individual that will able to protect them against sudden, unexpected handgun attack. Certain high profile individuals such as executives, diplomats, bodyguards, etc. may be under a constant threat of being a target of such an unexpected attack by armed individuals. In such situations this person would not have sufficient warning to protect himself with armored garments of the prior art.

Furthermore he could not comfortably or realistically wear such heavy and bulky garments as part of his day to day wardrobe. Although these individuals may seek protection in ballistic armor of the prior art they may lose their professional appearance due to the poor concealability of these aforementioned garments.

Further definition must be given to the term professional. A police officer will still maintain a professional appearance while wearing ballistic armor of the prior art even though the bulk of this armor, as well as its edges, and seams can easily be seen though the officer's shirt. However, a business person such as a banker or an executive wearing the same ballistic armor of the prior art would stand out among his or her colleagues. The user, if a high profile person such as an entertainer or a notable politician would be under closer scrutiny regarding the garments they wear.

This standing out may have a detrimental effect on the wearer in a professional sense. In addition an undercover police officer may wish to be protected in certain times from ballistic threats without fear that the armor being worn will undermine the "cover" of the officer. Therefore a garment that provides ballistic protection but that looks like ordinary every day wear of the wearer would be advantageous. The advantage would also be increase if that ballistic armor can take the form of formal, business, or casual type of attire to further suit the setting of the wearer.

The concealed types of body armor panels of prior art can become particularly uncomfortable in warm weather as the panels prevent ventilation of the body and restrict moisture removal. Since the body armor may not be worn in hot weather to avoid discomfort, this may place an individual at risk. Consequently, a need has arisen for concealable body armor which is convenient to wear, has a professional appearance for civilian users and allows ventilation when worn.

Furthermore the present invention adds to the degree of comfort of the wearer since one garment can be used for the combined purposes of ballistic protection and formal outerwear unlike examples of the prior art where separate garments must be worn, one type providing the ballistic protection and another independent type providing the formal wear typically worn over the ballistic garment.

Certain example of the prior art of the type to which the present invention relates is shown in U.S. Pat. No. 5,331,683 of Stones, et al. describes a protective body armor garment shell in the form of a vest can be worn over or in place of a standard uniform shirt and maintain a degree of professional appearance while concealing to a certain point the fact that body armor is being worn. Further, the vest as disclosed by the Stones, et al. patent '683 does not fully protect the wearer's side torso and, in particular, that torso portion immediately beneath the arms of the wearer remains vulnerable. The sides of a wearer are not covered or protected by either the front or back ballistic panels. It is contemplated that if an individual raises either arm, that the corresponding side portion of his upper torso would be exposed to bullet wound.

U.S. Pat. No. 4,266,297 of Atkins describes a ballistic panel carrier garment in the form of a shirt that permits its wearer to readily install and remove the ballistic panels. As a result, associated receptacle being dimensioned to protect at least 75% of the upper torso of the wearer; carrier panel made with these types are too restrictive, relatively bulky and heavy, tend to restrict mobility, and may fail to protect the exposed portion of the body. Further, the shirt as disclosed by the Atkins U.S. Pat. No. 4,266,297 does not fully protect the wearer's shoulder upper portion and, in particular, that torso portion immediately beneath the arms of the wearer remains vulnerable. The sides of a wearer are not covered or protected by either the front or back ballistic panels. It is contemplated that if a wearer raises either arm, that that corresponding side portion of his upper torso would be exposed to bullet wound.

U.S. Pat. No. 3,973,275 to Blauer. The Blauer Vest is a lightweight flexible garment intended to be unobtrusively worn under ordinary clothing by military personnel, civilian law enforcement authorities, and the like, to protect against sudden, unexpected handgun attack. The vest comprises a plurality of panels of KEVLAR™ or similar soft mid flexible ballistic fabric material, enclosed within a durable outer covering and joined together to completely encircle the wearer's torso so as to provide protection against attack from any direction.

The Blauer type vest resembles that of ballistic textile material known for military use to be worn over a standard military uniform shirt. A desirable objective of body armor vests for use in civilian law enforcement activities, however, is that they be inconspicuous. If the vest is not concealed from view; an attacker will aim at the head and exposed parts of the body rather than the torso, thereby defeating the effectiveness of the protective function of the garment. For this reason, vests like the Blauer vest are normally worn underneath not allowing for the garment to "breath and mostly used as a standard law enforcement uniform shirt or concealed by means of wearing other outer garment. This makes then uncomfortable for full time, and therefore would not be satisfactory for concealed long-term use such as by a regular day-to-day ordinary person. The vests may also snag or bind on the outer clothing, thereby inhibiting free body movement by the wearer.

What is needed is a new improved torso frame vest-like carrier garment modified as a base structure for frame design allows this garment to be adapted for all types of wearable apparel besides vests such as; jackets, coats, suits, shirts, etc. Concealable, seasonal, stylish ready-to-wear, wearable apparel protection fashion items can now be available in lightweight fabrics and unobtrusively worn under or wear over conventional attire sufficiently resemble that of underlying part of a vest as to render the vest unobtrusive to the casual observer, or an ensemble over a standard shirt of ready to wear fashion items.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles.

The torso shape vest-like frame and even the inserted soft body armor of the new improved art provide satisfactory protection to the body while not adversely impairing the wearer's mobility as in other types of personal ballistic armor. The new and improved adapted torso vest frame is less bulky and it is constructed for balance that can be tolerated for long periods of time.

All their methods are describes all the methods of garment constructions and its sewing techniques needed to deal with recurring cycles of fashion. Despite the fact that fashion is constantly changing, our approach is generic, allowing fashions items to their basic principles. These basic principles and their construction methods are applicable to many variations of a particular style and can be adapted to conform to the dictates of current trends.

BRIEF DESCRIPTION OF THE DRAWINGS

Embodiments of the invention have been chosen by way of example for purposes of illustrator and descriptions, and are shown in the accompanying drawings, wherein.

SUMMARY OF THE INVENTION

Figure 1:
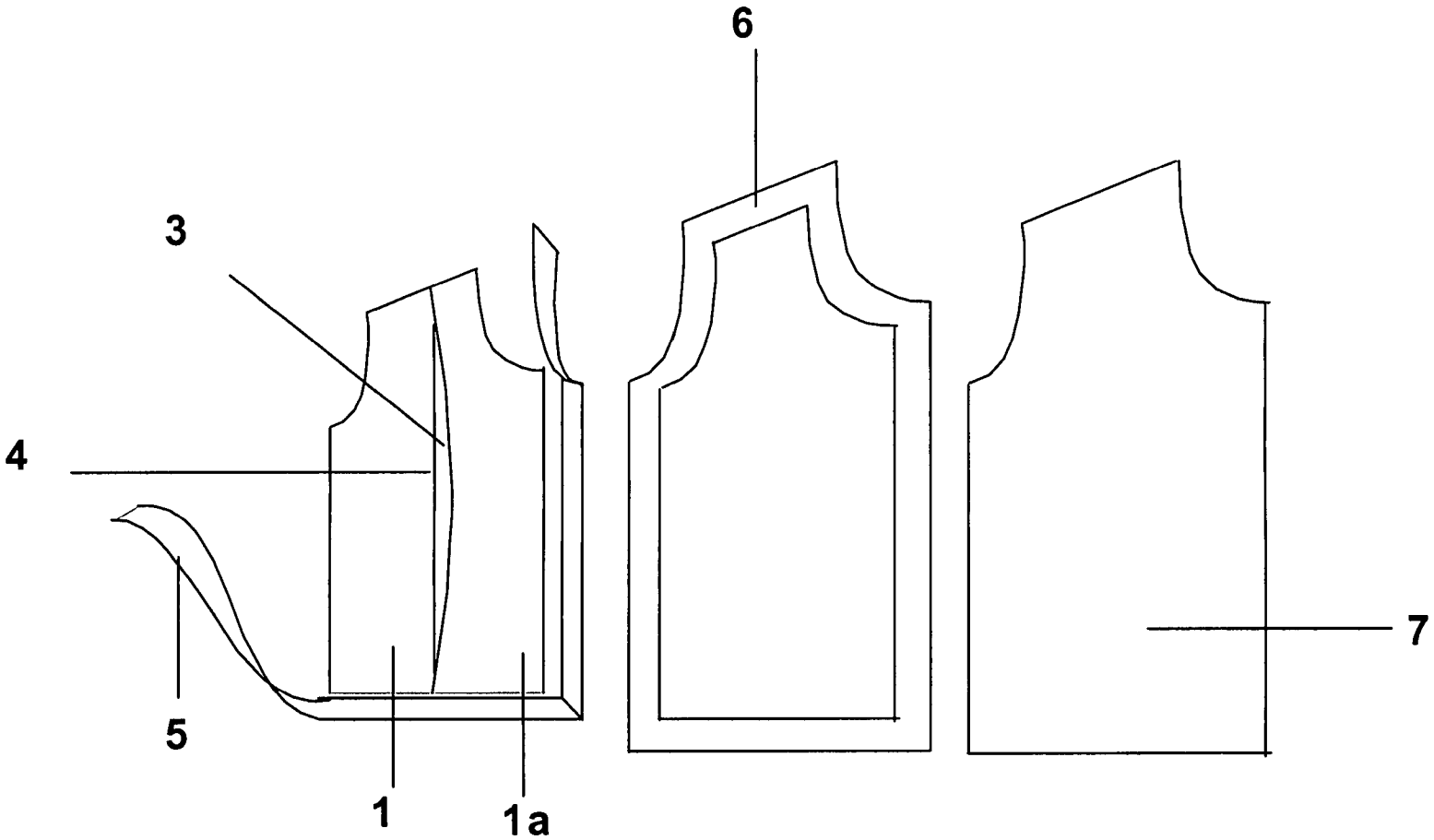
FIG. 1 is a front panel sectional view forming the interior layer section of the inventive shell of the present invention.

It is an object of the of the present invention to provide an adaptive torso vest-like garment with concealable protective body armor, that is functional, fashionable, and stylish, that can be unobtrusively worn.

It is a further object to provide an adaptable torso vest constructed for supporting an ensemble of ready to wear article of clothing to simulate as a regular fashionable garment, the ability to be worn over a shirt, to be part of a suit or that does not detract from the fashion or stylishness or image while providing ballistic protection without losing the advantage of concealment.

It is a further object to provide frame panels with a three dimensional pocket like receptacle for receiving the inserted protective pliable material.

It is another object to provide assemble torso vest independently constructed in its own adaptable design style suitable to incorporate onto other articles of clothing as part of a suit or ensemble.

It is a further object to provide assembled vest shell and the adaptive outer design shell being loosely drape, independent in its own movement to ease ventilation, flexibility, and comfort.

In an embodiment, the torso vest frame garment has a front section on the front side of a person wearing the garment and a back section on the back of said person, shoulder section front and back, sides section of front and back for connecting and completing the two sections to form the frame. In another embodiment, the torso vest frame garment shall be compromised of front and back panels, and rectangular frame panel disposed over a placement carrier, which incorporates the inserted or removable pliable protective body armor panels.

However, detachable front and side's rectangular frame panels both having separable zipper and Velcro fastener. Protective frame covering panels is placed in-between left front and right front closable center section and part of front and back side's rear section. Left front, left back and side's rear inner panel portion of the opposite adjacent inner layers may have VELCRO™ fasteners and separable zipper attached to complete the assembly. Protected frame are in place and secure close to the wearer's body to prevent the garment from shifting when the garment is worn.

The overlapping rectangular front panels are designed to double the wearer's protection to the closable front section beneath the wearer's body to protect heart, lung, kidneys, spleen and spine from sudden frontal attack even at close range.

The overlapping rectangular front and side rear panels are protected from the sides of the vest, designed to double the wearer's protection beneath the wearer's body which will stop a close range shot from a small caliber handgun.

Thus, the depth width of the binding receiving receptacles layer, and the thicknesses of the inserted pliable ballistics material to the front frame panel, back panel, and rectangular frame panel are comprised of both measures depending on the degree of comfort and flexibility sought relative to the degree of protection that is required. The panel protective pliable material sheets are made of high tensile strength synthetic fibers such as para-aramids like KEVLAR™, as well as Ultra high molecular weight polyethylene like SPECTRA™. The underlying torso frame shell is made of lightweight material, either cotton, silk, polyester blend, wool, or any such fabrics as used in an article of clothing to simulate an ordinary garment that is worn as typical office attire or formal attire. Thus, the protective concealable vest by itself can be worn as modish, stylish, or can be incorporate together with any ordinary fashion items such as jackets, coats, suits, etc.

In addition, this provides an ordinary individual with a professional appearance and allows the wearer to keep the protective armor on and in place during the sudden unexpected handgun attack.

The underlying torso shape frame vest of this invention includes front and back panel, and detachable rectangular front and side rear panel. It's front and back shoulder is secured joined at seams, front and back sides is secured joined at side seams, two separable side-rear detachable rectangular panels extending partial front side portion and back side portion, also separable detachable rectangular frame panel construct to center panel extending from the center front over the lateral portions part of the chest and to the waist.

DETAILED DESCRIPTION OF THE PREFERRED EMBODIMENTS

Those of skill in the art will better understand the preferred embodiments of this invention by reference to the constructed detailed sketch figures. The preferred embodiments of this invention are illustrated in the description where garment constructions of the figures are not intended to be exhaustive or to limit the invention to the precise form disclosed. They are chosen to describe or to best explain the principles of the invention and its application and practical use to thereby enable others skilled in the art to best utilize the invention.

A garment can have any shape, one skilled in the art will appreciate that the torso shape frame and its modified used of garment construction can have its advantages, can be adapted to include the carrier, can be unobtrusive, can be constructed with concealable protection and can be implemented and attached onto other garment such as; jackets, vests, suits, coats, vest jackets, hooded tops, etc. and still practice the invention.

In general, the stylish underlying torso frame shell referred to the current embodiment is preferred to be a carrier vest like garment.

The adapted shell is designed to closely resemble a standard vest. Preferably, composed of cotton, nylon, polyester, blend or similar material essentially identical to that used to produce a design adapted style or any combination thereof. This allows the shell to match the texture and color as well as the appearance of the garment or to make it more fashionable.

FIG. 1 is a front panel sectional view forming the interior layer section of the inventive shell of the present invention.

In order to accommodate such a ballistic panel referring to FIG. 1, a front torso shell frame panel is shown having individual successive overlying layers of fabric material. The inner fabric layers is divided in two sections a front inner right of right section 1 and a front inner right of left section 1A. An opening is provided between mid-sections 3. The seams portion 4 of the upper and lower section is sewn partially joined at seams. Pair of inseparable Zipper closure 8 (not shown) is provided attached onto the seams section to maintain the section in a closed, open condition allowing the inserted pliable concealable body armor panels 9 (not shown) to be placed into the pocket opening.

A continuous or semi-continuous strip of intermediate self-trim binding layer 5 is placed sandwiched between two layers, one edge of the seams is attached all around to the assembled inner surface layer outer edge sections of 1, 1A, the trim remaining seam edge portion is attached all around to the partially cut out facing layer inside edge sections of 6. The trim binding layer may also be a strip of gro-grain trim. The partially cut out facing layer contoured seam edge of 6 is identical similar in shape, measurements, dimension and proportion of the inner surface sections of 1, 1A.

Wherein, outer edge portion of the partially cut out facing layer 6 are also identical similar in shape, measurements, dimension and proportion matching the contoured outer layer edge of 7. The outer layer surface of 7 forms and acts as the main frame supporting the whole entire successive overlying layers the partially cut out facing layer 6, an Intermediate self-trim binding layer 5 and an inner surface layer sections 1 and 1A.

Figure 2:
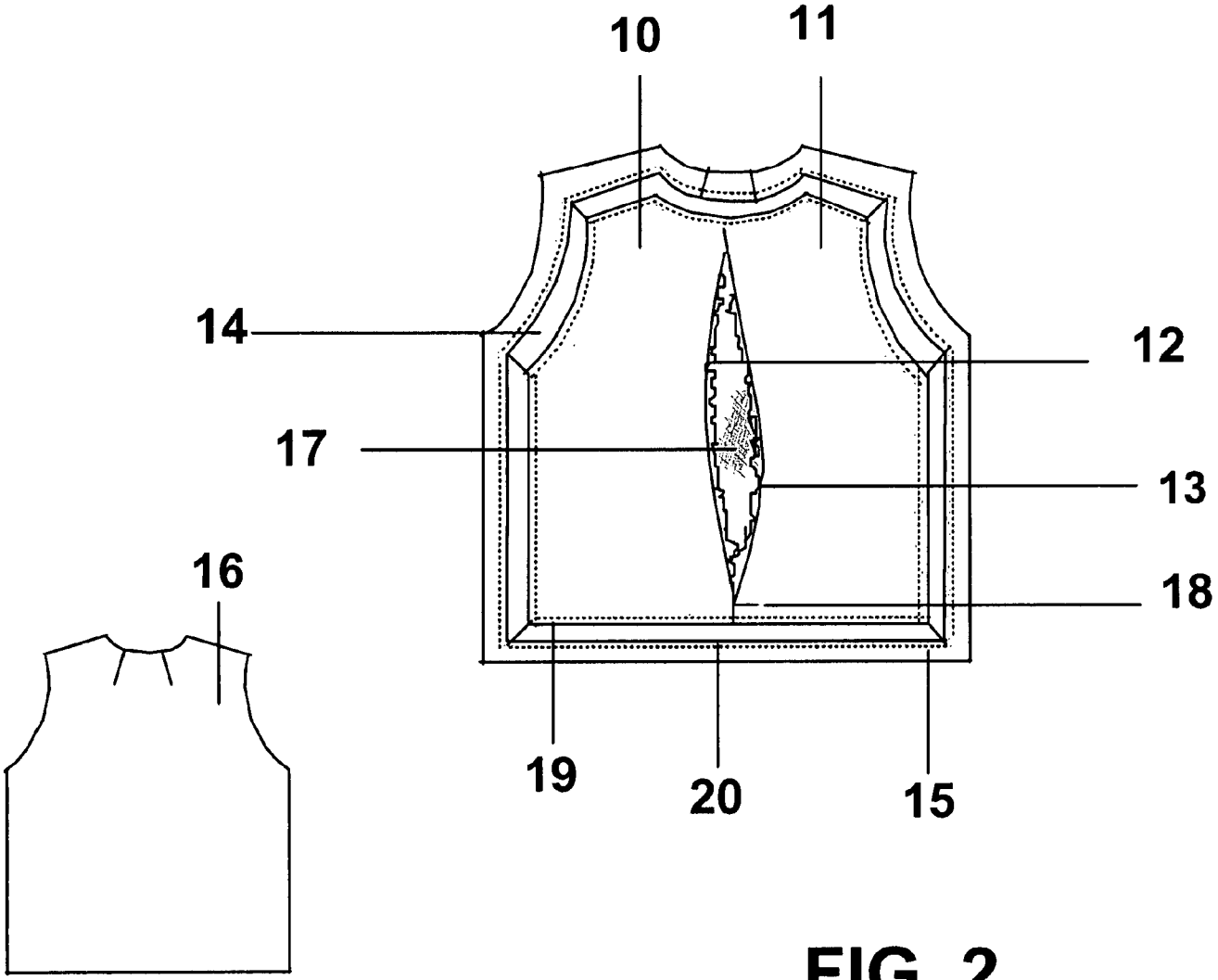
FIG. 2 is a view of an assembled garment shell back inner surfaces of the present invention.

FIG. 2 is a view of an assembled garment shell back inner surfaces of the present invention.

In similar fashion, Referring to FIG. 2, the successive individual layers is shown having the garment shell back panel portion in an assembled condition similar to FIG. 1. The constructed back panel is similar to the front panel, wherein each of the integrally formed frame panel portion comprise of individually successive layers of fabric materials includes an outer layer 16, functions for supporting the whole entire overlying layers, a partially cut out facing layer 15, are frame and attached together by stitching along its outer edges, a continuous or semi continuous strip of intermediate trim binding layer 14, in which seam directions intersect at an angle, wherein said article is capable of flexing along said seams disposed all around between the partially cut out facing layer edge and all around the assembled inner surface layer edge 10 and 11 forming a depth pocket like receptacle placement within. A free spacer in-between of which depth dimension of the receptacle is being configured, conform to size, proportion and thickness equally measured design to meet the size, proportion, thickness and the extent level of pliable ballistic body armor panels 17 allowing the inserted ballistic body armor to move freely within the pocket. The back panel portions of the inner surface forms of two sections back inner right section 10 and back inner left section 11. An opening is provided at mid-section 12, for receiving the inserted body armor 17 (shown in phantom). A pair of inseparable zipper closure 18 is provided sewn attached between seams 13 positions in a kissing relationship to the upper section and lower section of the opening in an open closed relationship. However, an additional edge stitched 19 is added sewn all around along edge of the inner surface and also additional edge stitched 20 is added sewn all around along the partially cut out facing layer edge. The same principle also applies to front panel portion of 21, 21A and 22, 22A.

With this additional seam, any ballistic force will be transmitted to the reinforced stitched seam 19 and 20, and will apply shear force to the inner surface and partially cut out facing surface. While providing secure stitching to depth pocket placement receptacle, the additional stitched seam does not detract from the garment appearance and there is no loss of bulkiness within the pocket receptacle.

Figure 3:
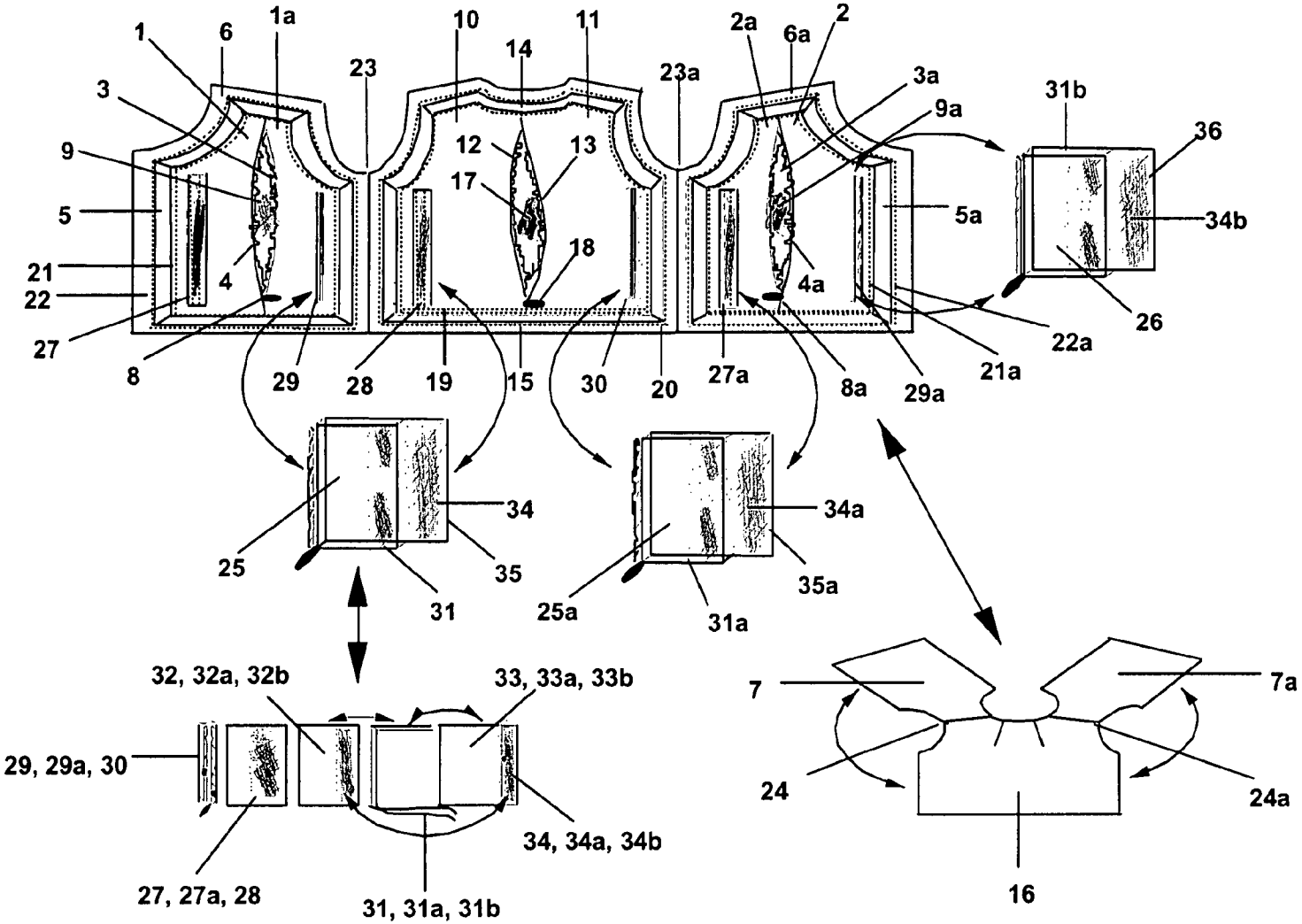
FIG. 3 is a view showing assembled garment shell inner surfaces of FIG. 1 and FIG. 2 as provided with releasable sides' rear flap panel portion and center flap panel portion.

FIG. 3 is a view showing assembled garment shell inner surfaces of FIG. 1 and FIG. 2 as provided with releasable sides' rear and center flap panel portion.

An illustrative embodiment of the method of fitting in accordance with the teachings of the present invention is disclosed in FIG. 3, as will now be described in detail.

Referring to FIG. 3, the garment shell of FIG. 1 and FIG. 2 is shown having front portion in addition, back portion in engaged condition. On each side of the vest the connecting seams shoulder portions 24, and 24A, and sides portions 23 and 23A, attached to the front and back portion and form a head opening, neck opening, front opening and a pair of armhole opening.

The integrally formed frame front panel portions include an inner layer 1, 1A, and 2, 2A. An opening is provided between mid-section 3, 3A a pair of inseparable zipper closures 8, 8A is attached between seams 4, 4A to maintain the sections in an open, closed condition. The inner layer also includes a pair of opposed fasteners 27 and 27A, a pair of mating separable zipper closures fasteners 29 and 29A along opposing front and sides thereof. An intermediate trim binding layer 5, 5A, 14, disposed in-between layers in which the seam directions intersect at an angle, wherein said article is capable of flexing along said seams, a partially cut out facing layer 6, 6A, 15, together forming a depth pocket like receptacle placement within allowing the pliable ballistic body armor panels 9, 9A, 17, placed in the pocket and an outer layer 7, 7A, and 16, for supporting the whole entire frame. The back panel is similar to the front panel, having each individually successive overlying fabrics comprised of an inner layer sections 10, 11. An opening is provided between mid-section 12.

A pair of inseparable zipper closures 18 is attached between seams 13 to maintain the sections in an open, closed condition. An intermediate trim binding layer 14 disposed in-between, a partially cut out facing layer 15 forming a depth pocket there-between and an outer layer 16 functions for supporting the entire frame. The inner layer also includes a pair of opposed fasteners 28 and a pair of mating separable zipper closures fasteners 30 along opposing back and sides thereof.

For illustrative purposes, the separable pair of zipper closures is sewn attached into the front, back and sides of the inner surface. Separable fasteners consist of VELCRO™. Shown alternatively, equivalent types of hook and pile fastener strips are provided along opposite sides. In additions to hook and pile type of fasteners, other types of separable fasteners could be used with the present invention such as; snaps, and hooks.

A detachable protective rectangular shaped pocket-like ballistic receiving receptacle 25, 25A and 26 are also provided attached to the inner surfaces of the adjacent overlaid section in an overlapping relationship partially positioned approximately midway extending the side front right and left chest section and side rear back left and right chest section, and respectively at center front right, left center chest section of the wearer's garment increasing the level of protection to the user.

Each rectangular receiving receptacle center flap 26 and side rears flap 25 and 25A which may be fabricated of cloth or the like, comprise of fabrics layers having an outer surface layer 32, 32A and 32B, an inner surface layer 33, 33A and 33B and an intermediate strip of trim binding layer 31, 31A, 31B disposed between layers form a depth pocket like receptacle. A free spacer placement is defined by intermediate trim binding layer and is dimensioned and configured, conform to size, and thickness equally measured to size, in addition, thickness and the extent level of the inserted pliable ballistic armor panels which can be contained therein to provide supplemental protection to vital organs like the heart.

An opening is provided between layers at side's overlaid sections 35, 35A and 36. A pair of mating separable fasteners 34, 34A, and 34B is provided on the opposites sides of the overlaid sections to maintain the sections in an attached, detached condition.

The outer layer is provided with complimentary element types of a conventional releasable closures means, such as mated pair of separable zipper closures 29, 29A, 30 and a strip of separable fasteners 27, 27A, 28 are VELCRO™ alternatively, equivalent hooks and pile fastening material. Adjacent front and back inner surfaces section 1, 1A, 2, 2A and 10, 11 is provided with a complementary element sewn topstitch to the inner surface which cooperates with the element. Each fastener is of sufficient length to allow adjustment to conform to fit the user making detachable rectangular flap carrier panel completing it's function in an attached/detached conditions. The same principle also applies to the sides rear front, back and center of the wearer's garment.

Figure 4:
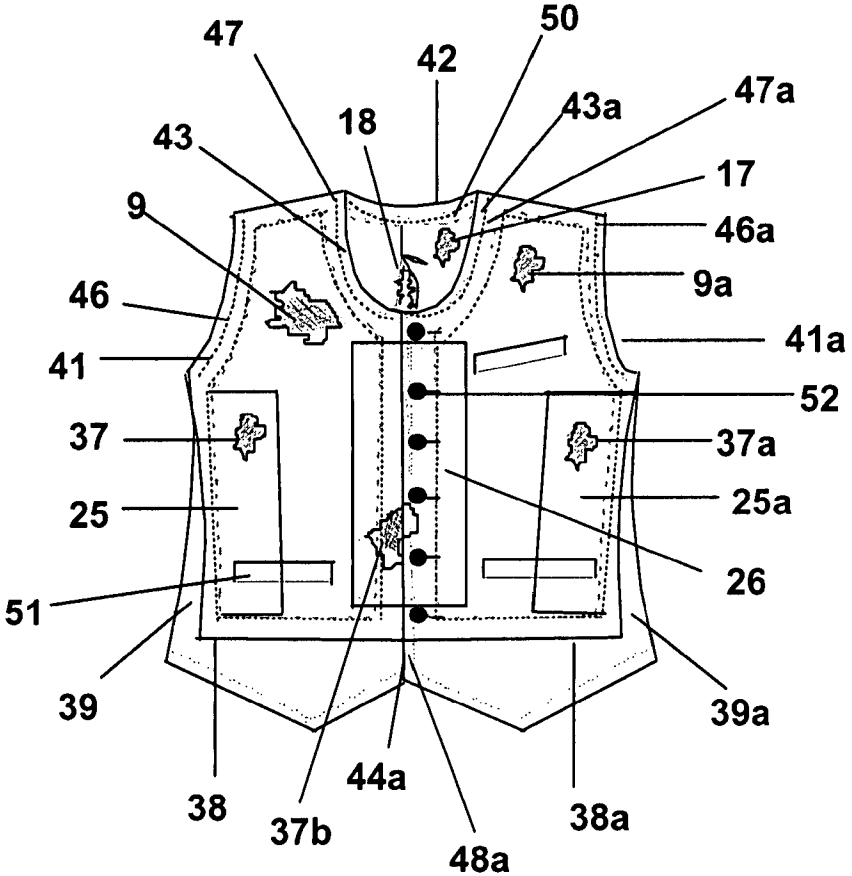
FIG. 4 is a front and back view of the assembled vest in accordance with the present invention as it would place attached onto the adapted garment.
Figure 4:
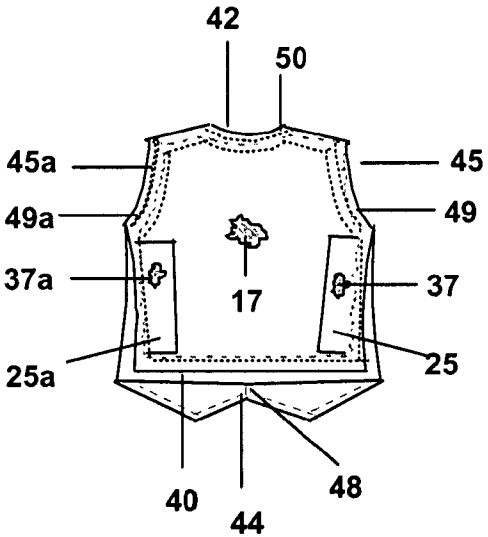

FIG. 4 is a front and back view of the assembled vest in accordance with the present invention as it would place attached onto the adapted garment.

The assembling and wearing of the Vest-like garment is illustrated best in FIG. 4. Referring now to the drawings, by way of example, a stylish Ready to Wear protective garment of the present invention, embodied in the form of a body armor vest, in general and in particular as best shown in FIG. 4. Preferably, the garment shell is composed of cotton, polyester, or similar material essentially identical to that used to produce designer clothes. In combination, this allows the shell to match the texture, and colors as well as the appearance closely resemble that as part of a designed ensemble of the garment which includes buttoned closures 52, and pockets 51 or various other types of attachments, or fabricated in a vest-like design. However, it will be best understood that it's modified construction may be adapted, to any vest or jackets-like garment to include the carrier features are contemplated to be within the scope of the present invention.

In an illustrative embodiment, for purposes of an exemplary showing, the underlying body armor vest like garment and which may be formed of cloth or the like, having assembled front and back panel portions contains a pair of arm opening, a back neck opening, a front neck opening, a waist opening and a closable front section opening is provided.

Prior to disposing of the protective garment shell into an article of clothing, wherein the adapted garment is in the nature of a vest as shown in FIG. 4. This façade covers a carrier garment disposed beneath the façade and connected along the edge of the opening circumference of front armhole 41, 41A, a back armhole 45, 45A, a front neck 43, 43A, a back neck 42 and the closable front portion forming a right half section 44 and a left half section 44A by sewing or the like along a line adjacent opening to the adapted vest. When the combined garment is worn by the wearer, as illustrated in FIG. 4, is shown the carrier shell made fitted inside closely to the wearer body, and outer façade layer of the vest garment being loosely draped independently along at sides 39, 39A and at front waist 38, 38A and back waist 40 giving the users desired to increase comfort both choice achieving fashionable style and protections.

Thus the garment shell vest and the torso frame being draped over the person's adjacent front chest and side rear body maintains the rectangular panel body armor in a overlapping position to protect the side rears 25, 25*a* and front chest 26. If necessary, the designer vest functional front closure buttons fasteners 52 would be engaged to provide a neat appearance. Since the garment simulates the appearance of a regular designer vest, the individual can maintain a professional appearance yet maximizes protection and comfort. If the individual is wearing a shirt, T-shirt or a sweater beneath this garment shell, he can operate free of the vest without having to disrobe. Similarly, the designer garment vest can also be quickly applied over a shirt, sweater, jacket, etc., if necessary. This quick on and off feature overcomes a major inconvenience and should increase the utilization of such garments.

Figure 5:
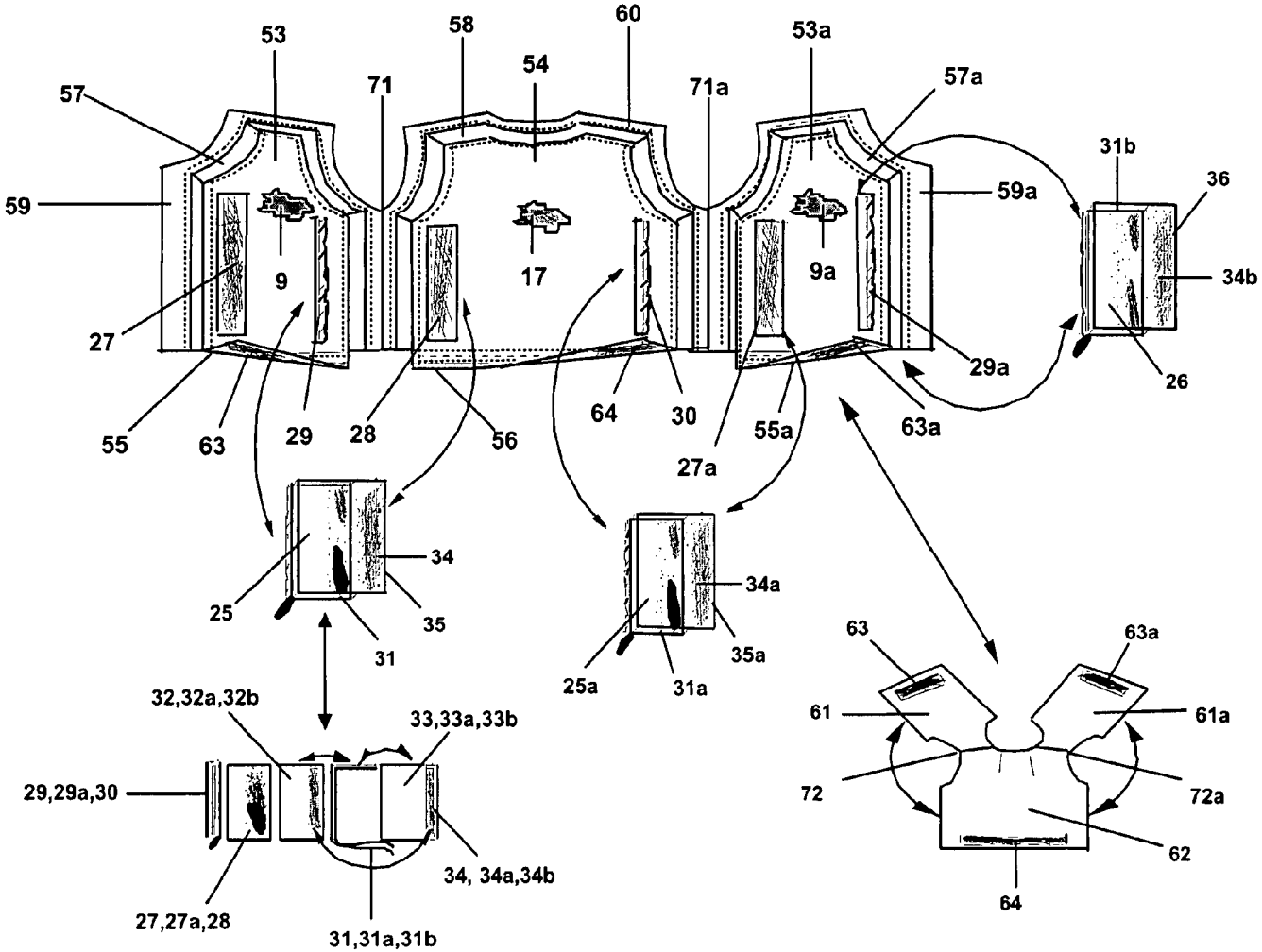
FIG. 5 is another alternative embodiment of the torso vest showing modified construction to front and back section of the present invention.

In the embodiment shown in FIG. 3 and FIG. 5, releasable sides rear front and back 25 and 25A and center carrier panel 26 is generally of a rectangular configuration are attached partially extending to the inner surfaces of right chest section and left chest section and center chest section respectively. Each receptacle which may be fabricated of cloth or the like is of a substantially similar configuration and size in order to support the inserted pliable ballistic panel 37, 37A and 37B in a manner with respect to the upper torso of the garment wearer.

For example, a garment shell having a front panel with an outer fabric layer and a torso frame with an inner fabric layer may use a pair of separable zipper closure and a pair of mating pile fasteners along the adjacent inner front and adjacent inner side rears, for attachment to the sides of the back inner panels. The front torso frame inner layer and the inner side front and rearward back layers are attached to a rectangular panel.

The separable zipper closure and pair of pile fasteners strips which ease fastening and unfastening are attached to the inner layer s and the rectangular panel layer and along the seams edge. Such a garment shell was subject to ballistic impact and it was found that the impact might cause a force to be exerted on the assembled torso frame, which is transmitted to the seam. When this occurs, the force may be sufficient and cause the inner layer to pull and separable fasteners to peel apart and separate, releasing the detachable rectangular front and side rear panel from the body. Thus, the impact simulates the pulling force used to separate such fasteners.

Another feature of the invention is that the garment shell front panel and the torso frame panels are secured together against the body upon ballistic impact. It was found during testing that detachable rectangular front and side panel must be attached to the torso frame front inner panel and to the side rear torso inner panel in a particular way to avoid separation of the fasteners upon ballistic impact. Should separation occur, there is a potential vulnerability to additional impacts.

FIG. 5 is another alternative embodiment of the torso vest showing modified construction to front and back section of the present invention.

A modified form of the vest illustrated by the vest opening shown in Referring to FIG. 5, the garment shell showing similar construction as shown in FIG. 3, on each side of the vest having front portion and back portion in engaged condition. The connecting seams shoulder portions 72, and 72A, and sides portions 71 and 71A, attached to the front and back portion and form a head opening, neck opening, front opening and a pair of armhole opening.

A modified extended pocket receptacle form of construction where protective body armor can be inserted through an opening is illustrated shown in FIG. 5.

As indicated, the front inner surface 53, 53A and back inner surface 54 of the vest lower sections are extended to about 2" to 2½" from the partially cut out frame lateral to the front and back waist. The portion edges of seam where trim binding are sewn attached together to the inner layer seam edges and to the partially cut out frame layer edges to form a depth pockets like receptacle. Openings are provided 55, 55A, and 56 of the vest bottom hem and the extended layer are sewn with a mating pair of opposite fastener. Free spacer within the receptacle is determined only by the width of the trim bindings sewn in-between the inner seam layer and the partially cut out facing layer in which depth is being configured, dimensioned; correspond to the thickness respectively, matching the panel layers of the protective body armor insert 9, 9A and 17 of the vest. In the embodiment shown in (See FIG. 4 and FIG. 6) the garment shell also includes a releasable detachable rectangular carrier receptacle frame panels which extends over the front of the wearer's chest and to the waist the same principle also applies to the side rears and center of the wearer's torso is dimensioned to serve as a carrier for a flexible ballistic panel.

As shown the front inner surface is similar to the back inner surface having a strip of mated VELCRO™. One surface of the adjacent inner frame layer is provided with one element of a conventional releasable fastening means, such as a strip of separable zipper closure and pile fastening material 27, 27*a* and 28 are sewn to either side of the inner surface layer of the bodice and a pair of mating separable zipper closures fasteners 29 and 29A and 30 along opposing front and sides thereof adjacent to the rectangular panel section of 25, 25*a* and 26 sections making detachable rectangular frame panel completing its function in attached/detached conditions.

Another feature of the invention is that the garment shell front and back pocket receptacle are secured together. An additional edge stitched 19 is added sewn all around along edge of the inner surface and also additional edge stitched 20 is added sewn all around along the partially cut out facing layer edge. The same principle also applies to front panel portion of 21, 21A and 22, 22A.

Figure 6:
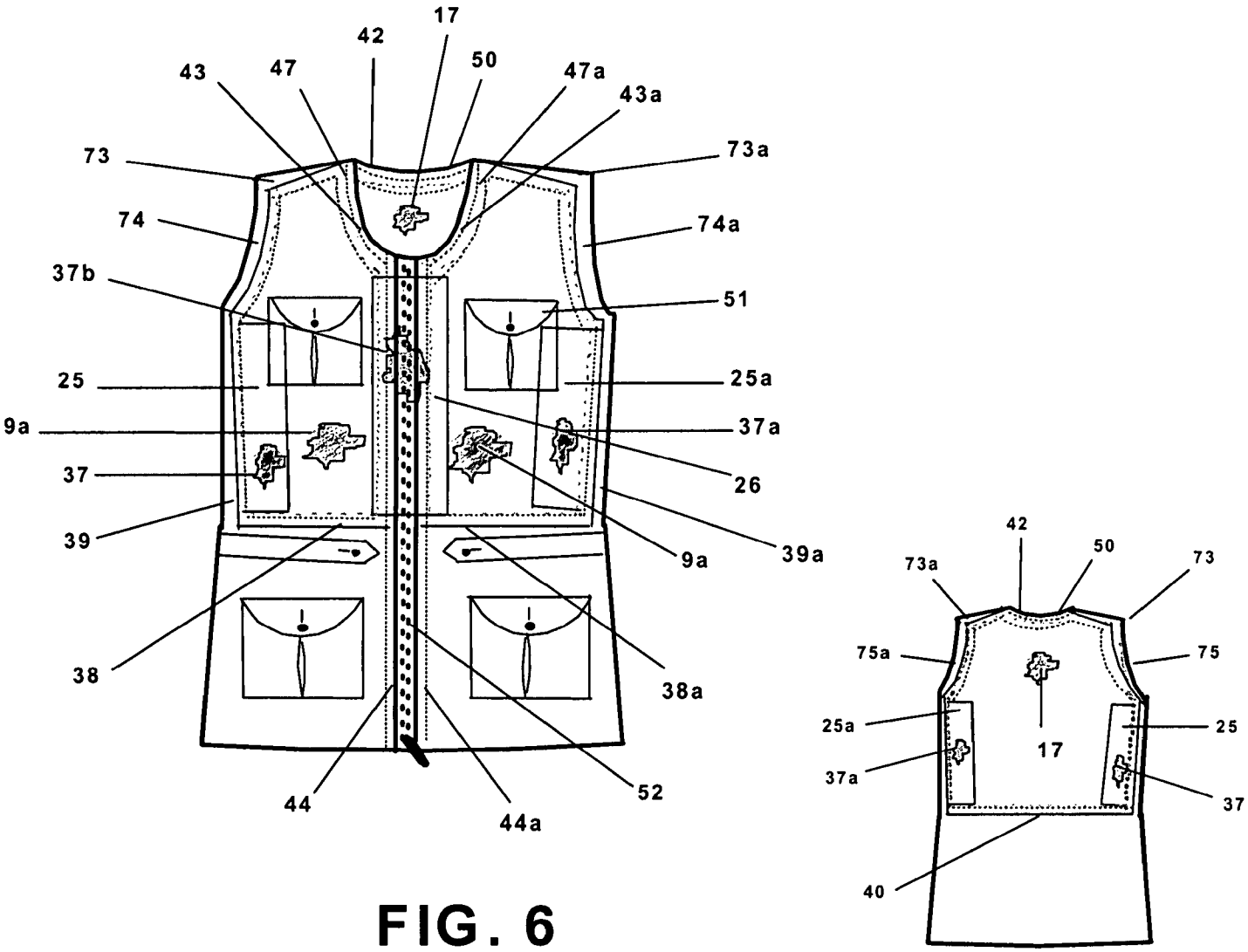
FIG. 6 is a front view of an alternative embodiment showing a modified form of construction in accordance with the present invention, showing the underlying carrier shell as it would be placed attached onto the adapted garment.

FIG. 6 is a front view of an alternative embodiment showing a modified form of construction in accordance with the present invention, showing the underlying carrier shell as it would be placed attached onto the adapted garment.

Worn in combination the conventional safari vest in accordance with the present invention as best shown in FIG. 6, showing the underlying carrier shell as it would be placed attached onto the adapted garment. It is contemplated that the potential wearer, may already have acquired selected of a great number of ballistic panels of varying size and configuration. Therefore, in view of marketing and economic considerations, it is necessary to adapt the ballistic panel carrier garment of this invention to receive a selected one of a variety of sizes and configurations of ballistic panels.

As shown the adaptive garment of the present invention and its method of fitting, as disclosed, are needed to support and accurately position to a great variety of design variations that is presently available.

The fitting of the ballistic panel carrier garment of this invention to the selected panel in accordance of teachings of this invention is extremely important in that the selected ballistic panel needs to be properly positioned, without shifting, with respect to the upper portion of the wearer's torso. Otherwise, the wearer will be exposed to significant danger in that portions of his body will be unprotected from ballistic impact. Further, sliding panels may become doubled over causing the garment and its panels to become extremely uncomfortable to wear.

Yet, the Ready to Wear body armor garment shell of this invention has many of the characteristics of ordinary clothing in that it is lightweight, is completely dry cleanable, washable and can be tailored to fit the individual user so that it can be worn comfortably without telltale bulges. It can be worn as an ordinary jacket during the fall, winter, summer and spring months under a shirt during the summer months or sweater during the winter months. Note that the cooperating portions of zipper 52 are shown in FIG. 6. For that purpose, having assembled carrier garment front and back panel portions contains a pair of arm opening, a back neck opening, a front neck opening, a waist opening and a closable front section opening is provided. This façade covers a carrier garment disposed beneath the façade and connected along the edge of the opening circumference of a front neck 43, 43A, a back neck 42 and the closable front portion forming a right half section 44 and a left half section 44A by sewing or the like along a line adjacent opening to the adapted garment.

Connecting means for interconnecting the opening seams of the assembled carrier garment front section and the back section, by sewing or the like along a line adjacent opening to the adapted garment front section and back section. Each of the closable front sections is provided with one element of a conventional releasable fastening means, such as a strip of separable zipper closure 52 so that they may be secured to one another in a kissing relationship to close the front of the combined garment over the user's chest and stomach.

When the combined garment is worn by the wearer, as illustrated in FIG. 6 is shown the carrier shell made fitted inside closely to the wearer body, and outer façade layer of the garment being loosely draped independently along at sides 39, 39A at front waist 38, 38A and back waist 40 at shoulders 73, 73A at front armholes 74, 74A and back at armholes 75, 75A giving the users desired to increase comfort both choice achieving fashionable style and protections.

One object of this invention is to provide a protective Ready to Wear carrier garment of the type mentioned, that is more comfortable for a person to wear than hitherto known. Another object of this invention is to provide a protective Ready to Wear carrier garment of the type mentioned, that provides the wearer with more mobility, unobtrusive style than hitherto known.

Also, due to the specific construction of the Ready to Wear carrier garment, it is very simple to adapt the type mentioned to different persons having different torso sizes and waist measurements.

The invention claimed is:

1. A ballistic carrier panel having a three dimensional receptacle with a depth and an opening comprised of successive overlapping layers:

a. an inner layer;

b. a trim binding layer;

c. a facing layer; and d. an outer layer wherein the successive layers form the three dimensional receptacle for a pliable ballistic panel having a thickness and the depth of the three dimensional receptacle is about the thickness of the pliable ballistic panel.

2. The ballistic panel of claim 1, wherein the three dimensional receptacle opening is located within the inner layer.

3. The ballistic panel of claim 1, wherein the trim binding layer is semi continuous with a non-continuous portion of the trim binding layer forming the three dimensional receptacle opening, and the inner layer having an extended portion that forms a flap to cover the three dimensional receptacle opening.

4. The ballistic panel of claim 1, wherein the facing layer is partially cut out and has an inner edge and an outer edge, and the inner layer has an outer edge and the outer edge of the inner layer and the inner edge of the facing layer are about the same shape.

5. The ballistic panel of claim 1, wherein the trim binding layer is gro-grain or self-trim.

6. The ballistic panel of claim 1, wherein the three dimensional receptacle opening includes a means of closing the opening.

7. The ballistic panel of claim 6, wherein the means of closing the opening is a zipper.

8. A carrier shell comprised of:

a. a front ballistic carrier panel comprised of successive overlapping layers: a first inner layer, a first trim binding layer, a first facing layer, and a first outer layer, wherein the successive layers form a first three dimensional receptacle with a depth and an opening for a first pliable ballistic panel having a thickness and the depth of the first three dimensional receptacle is about the thickness of the first pliable ballistic panel;

b. a back ballistic carrier panel comprised of successive overlapping layers: a second inner layer, a second trim binding layer, a second facing layer, and a second outer layer, wherein the successive layers form a second three dimensional receptacle with a depth and an opening for a second pliable ballistic panel having a thickness and the depth of the second three dimensional receptacle is about the thickness of the second pliable ballistic panel;

c. wherein the front ballistic carrier panel and the second ballistic carrier panel are connected at a first and second shoulder seam so as to form a neck opening having a neck edge, and at a right seam and a left side seam so as to form a right arm opening and a left arm opening.

9. The carrier shell of claim 8, wherein the carrier shell is further comprised of at least one detachable ballistic carrier panel having a three dimensional receptacle with a depth and an opening comprised of successive overlapping layers: an inner layer, a trim binding layer, and an outer layer, wherein the successive layers form the three dimensional receptacle for a pliable ballistic panel having a thickness and the depth of the three dimensional receptacle is about the thickness of the pliable ballistic panel; and an edge of the detachable ballistic panel is provided with a first separable fastener and an opposing edge of the detachable ballistic panel is provided with a second separable fastener so that the detachable ballistic panel can be secured in overlapping relationship with at least one of the right side seam or left side seam of the carrier shell.

10. The carrier shell of claim 9, wherein the first and second separable fasteners are each a first half of a pair of mating separable fasteners with a second half of the first separable fastener being on the inner layer of the ballistic carrier panel on one side of the left seam or right seam, and a second half of the second separable fastener being on the inner layer of the opposite side of the left seam or the right seam such that when the first half of the first separable fastener is joined with the second half of the first separable fastener and the first half of the second separable fastener is joined with the second half of the second separable fastener the detachable ballistic carrier panel overlaps the left seam or the right seam of the carrier shell.

11. The carrier shell of claim 10, wherein the mating separable fastener is a zipper or hook and loop fastener.

12. The carrier shell of claim 11, wherein the first and second mating separable fasteners are not the same.

13. The carrier shell of claim 8 further comprised of an outer garment having a neck opening with a neck opening edge, a right arm opening; and a left arm opening; wherein the outer garment and the carrier shell are connected at their respective neck opening edges.

14. The carrier shell of claim 8, wherein the front ballistic carrier panel is comprised of a. a right ballistic carrier panel connected on its right side to a right side of the back ballistic carrier panel at a first shoulder seam and a right side seam forming a right arm hole and right half of a neck opening;

b. a left ballistic carrier panel connected to a left side of the back ballistic carrier panel at a second shoulder seam and a left side seam forming a left arm hole and a left half of a neck opening; and c. a left side of the right ballistic panel having a right opening edge and a right side of the left ballistic panel having a left opening edge are left unattached so as to form a front opening for the carrier shell.

15. The carrier shell of claim 14, wherein the carrier shell is further comprised of at least one detachable ballistic panel having a three dimensional receptacle with a depth and an opening comprised of successive overlapping layers: an inner layer; a trim binding layer; and an outer layer, wherein the successive layers form the three dimensional receptacle for a pliable ballistic panel having a thickness and the depth of the three dimensional receptacle is about the thickness of the pliable ballistic panel; and an edge of the detachable ballistic panel is provided with a first separable fastener and an opposing edge of the detachable ballistic panel is provided with a second separable fastener so that the detachable ballistic panels can be secured in overlapping relationship with at least one of the right side seam, the left side seam, or the front opening of the carrier shell.

16. The carrier shell of claim 15, wherein the first and second fasteners are each a first half of a pair of mating separable fastener with a second half of the first separable fastener being on the inner layer of the ballistic carrier panel on one side of the left seam, right seam, or front opening and a second half of the second separable fastener being on the inner layer of the opposite side of the left seam, right seam, or front opening such that when the first half of the first separable fastener is joined with the second half of the first separable fastener and the first half of the second separable fastener is joined with the second half of the second separable fastener the detachable ballistic carrier panel overlaps the left seam, the right seam, or the front opening.

17. The carrier shell of claim 16, wherein the mating separable fasteners are a zipper or hook and loop fastener.

18. The carrier shell of claim 17, wherein the first and second mating separable fasteners are not the same.

19. The carrier shell of claim 14 further comprised of an outer garment having a neck opening with a neck opening edge, a right arm opening; a left arm opening; and a front opening with a right side opening edge and a left side opening edge; wherein the outer garment and the carrier shell are connected at their respective neck opening edges, right side opening edges and left side opening edges.

* * * * *